US011125030B2

(12) United States Patent
Guigon De Araujo

(10) Patent No.: US 11,125,030 B2
(45) Date of Patent: Sep. 21, 2021

(54) GUIDING SYSTEM ON A HYBRID LIFTING TOWER, AND HYBRID LIFTING TOWER

(71) Applicant: ODEBRECHT ÓLEO E GÁS S.A., Rio de Janeiro (BR)

(72) Inventor: Rafael Machado Guigon De Araujo, Rio de Janeiro (BR)

(73) Assignee: ODEBRECHT ÓLEO E GÁS S.A., Rio de Janeiro (BR)

( * ) Notice: Subject to any disclaimer, the term of this patent is extended or adjusted under 35 U.S.C. 154(b) by 0 days.

(21) Appl. No.: 16/704,412

(22) Filed: Dec. 5, 2019

(65) Prior Publication Data

US 2020/0199953 A1 Jun. 25, 2020

(30) Foreign Application Priority Data

Dec. 21, 2018 (BR) ..... BR1020180768689

(51) Int. Cl.
*E21B 19/24* (2006.01)

(52) U.S. Cl.
CPC ..... *E21B 19/24* (2013.01)

(58) Field of Classification Search
CPC ..... E21B 17/01; E21B 17/012; E21B 19/24
See application file for complete search history.

(56) References Cited

U.S. PATENT DOCUMENTS 3,708,811 A * 1/1973 Flory ..... B63B 22/021 441/5
4,391,332 A * 7/1983 Fayren ..... E21B 17/015 166/350
4,462,717 A * 7/1984 Falcimaigne ..... E21B 17/015 405/224.3
4,470,722 A * 9/1984 Gregory ..... E21B 17/01 405/224.2
4,477,207 A 10/1984 Johnson
5,377,763 A * 1/1995 Pearce ..... E21B 17/01 166/367
6,837,311 B1 * 1/2005 Sele ..... B23K 20/122 166/345
8,783,630 B2 7/2014 Gronlund et al.
8,888,412 B2 * 11/2014 Pionetti ..... B63B 21/508 405/224.2
9,334,695 B2 * 5/2016 Hatton ..... E21B 17/085
2010/0172699 A1 * 7/2010 Saint-Marcoux ..... E21B 17/012 405/224.2

FOREIGN PATENT DOCUMENTS

EP 2 699 755 6/2017
FR 2942497 A1 * 8/2010 ..... E21B 17/012
WO 2009/134986 11/2009

* cited by examiner

*Primary Examiner* — Matthew R Buck
(74) *Attorney, Agent, or Firm* — Wenderoth, Lind & Ponack, L.L.P.

(57) ABSTRACT

A guiding system for a hybrid lifting tower includes: one or more guiding structures configured to be positioned along the hybrid lifting tower. The guiding structures comprise main parts adapted to be attachable to the hybrid lifting tower. The main parts are adapted for passage of pipes. One of the guiding structures is connected to at least one other adjacent guiding structure and/or to a tower ending structure by at least one structural connecting member. A hybrid lifting tower including the guiding system is also disclosed.

9 Claims, 4 Drawing Sheets

GUIDING SYSTEM ON A HYBRID LIFTING TOWER, AND HYBRID LIFTING TOWER

FIELD OF INVENTION

The present invention relates to lifting towers for oil outflow. More specifically, the present invention relates to guiding systems positioned at one or more points along a lifting tower for oil outflow.

BACKGROUND OF THE INVENTION

Hybrid lifting towers are known to form part of the so-called hybrid riser, with upper portions made of flexible and suitable pipelines for the development of deep and ultra-deep water fields. These towers consist of a central structural core, supporting a riser beam, with some pipelines used for oil production, some used for injection of water, gas and/or other fluids, and others used to transport oil and gas to other production and storage stations (FPSO).

Hybrid lifting towers are known to have several guiding structures along their length to guide the peripheral pipelines and other lines relative to the central structural core.

EP2699755 B1 describes an example of a hybrid lifting tower system.

U.S. Pat. No. 4,477,207 A discloses a pipe-mounted float assembly, such as a riser with service lines extending therethrough; the assembly includes foam arched float modules to be place against the riser, and to be releasably attached to the spaces between the service lines, and to make a generally cylindrical outer contour, the modules being held in place against the tube by tensioning straps, which each of them would comprise a belt being tensioned by a tensioning bar.

Document WO 2009134986 A2 describes a rising column clamp comprising clamping parts that can be opened and closed in connection to one another. Each of the clamping parts includes a thermoplastic body which may be, for example, injection molded polyethylene parts. The clamp parts may be connected by a hinge that is integrally formed with them. The clamp may also include brackets and covers to hold the auxiliary lines.

U.S. Pat. No. 8,783,630 B2 shows a multi-part riser clamp designed to carry a variety of fluid tubes together with and far from a surface coated steel riser whose riser is designed to be placed at sea for communication between a wellhead and seabed and a surface vessel. The clamp is designed for frictionally non-rotatable attachment to the surface coated riser and it is further provided with a variety of tube seals that carry the respective fluid tubes.

The state-of-the-art documents provide multiple configurations of guiding structures for oil well drilling riser pipes and oil and gas production. However, there are still gaps in the state-of-the-art to be filled in order to increase the safety of the production system, to limit or reduce the lifting tower bending, to reduce fatigue damage to the tower elements, and to make it possible to eliminate the need for structural core (pipe).

As further detailed below, this invention aims at solving the above described state-of-the-art problems in a practical and efficient manner.

PURPOSES OF THE INVENTION

This invention aims at providing a guiding structure system that increases the safety for the oil and gas production system, guiding and aligning the peripheral pipes along the lifting tower, increasing the flexural stiffness of the lifting tower by limiting or reducing bending, and reducing fatigue damage on the lifting tower elements.

SUMMARY OF THE INVENTION

In order to achieve the above objectives, the present invention provides a guiding system in a hybrid lifting tower comprising one or more guiding structures positioned at one or more points along a lifting tower, wherein the guiding structures includes main parts adapted to be attachable to the lifting tower structure, wherein the main parts are adapted for pipe passage, then a guiding structure is connected to at least one other adjacent guiding structure and/or a tower end structure by at least one structural connecting member.

This invention also provides a hybrid lifting tower including the guiding system described above.

BRIEF DESCRIPTION OF THE FIGURES

This detailed description refers to the attached figures and their respective reference numbers.

DETAILED DESCRIPTION OF THE INVENTION

First and foremost, it is emphasized that the following description will depart from preferred embodiments of the invention. However, the invention is not limited to such particular embodiments.

Figure 1:
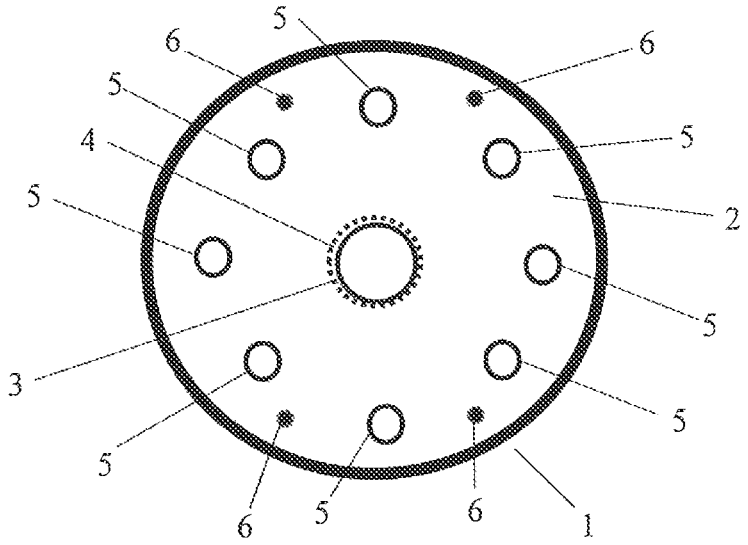
FIG. 1 shows a cross-sectional view of a hybrid lifting tower comprising a guiding system according to the preferred embodiment of this invention.

FIG. 1 shows a cross-sectional view of a hybrid lifting tower 1 comprising a guiding system according to a first embodiment of this invention. The cross-sectional view of the lifting tower 1 of this invention shows a guiding structure 2 coupled to a structural central pipe 3. The guiding structure 2, as comprised in the present invention, may be glued or welded to the central pipe 3 by the interface 4 between the guiding structure 2 and the central pipe 3. Alternatively, the guiding structure 2 may shift transversely in relation to the central pipe 3 for stress compensation in the hybrid lifting tower structure 1. In this case, there is no glue or weld joining the guiding structure 1 to the central structural pipe 3.

The guiding structure 2 may be formed from two or more main parts of a preferably metallic or polymeric material. Production and/or injection pipes 5 are provided together with the central structural pipe 3. The production and/or injection pipe 5 are kept parallel and at a substantially invariable distance from the central structural pipe 3 due to the building of the guiding structures 2.

Figure 3:
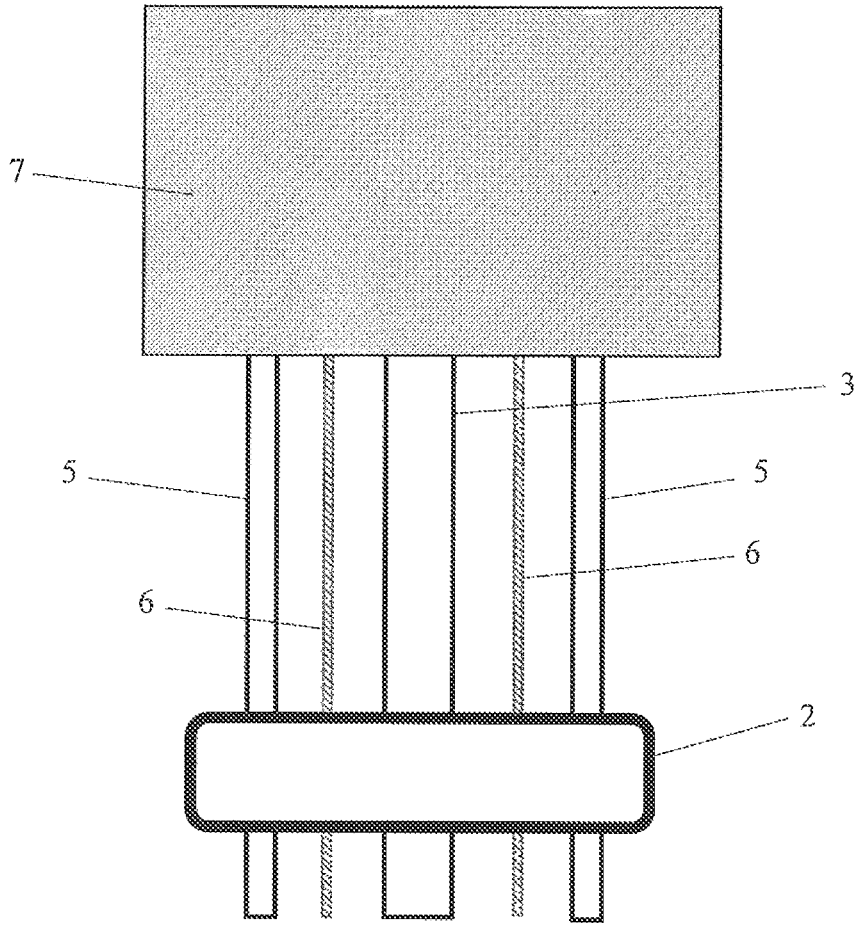
FIG. 3 illustrates the connection between the lifting tower and the structure at the end of the lifting tower.

Additionally, this invention provides connecting elements 6 which connect two adjacent guiding structures 2 or, as shown in FIG. 3, a guiding structure 2 and an ending structure 7 of tower 1.

According to this invention, the guiding structures 2 carry out the following duties: restricting lateral displacement of the ducts, allowing axial displacement due to operating fluid pressure and temperature; withstand the vibration loads of the pipelines during transport and after tower 1 is installed; and limiting lateral deflection due to the drag force and vibration of the ducts 5.

An example of ending structure 7 of hybrid lifting tower 1 could be an URTA (Upper Riser Termination Assembly) at the upper ending or a LRTA (Lower Riser Termination Assembly) at the lower ending.

Figure 2:
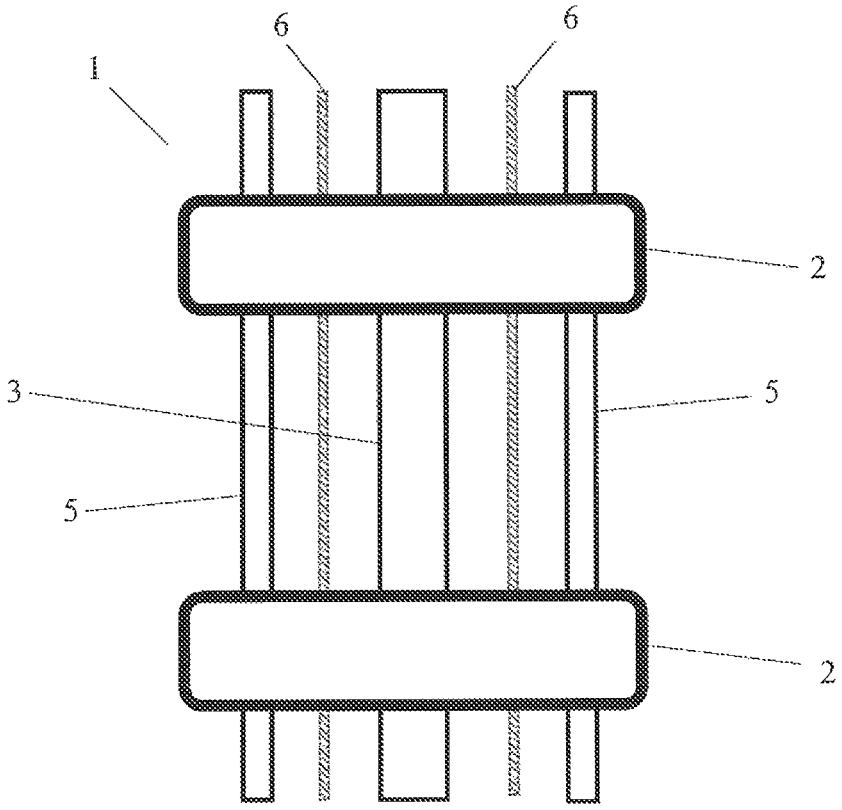
FIG. 2 shows a side view of a portion of the lifting tower according to the preferred embodiment of this invention.

FIG. 2 shows a side view of a portion of the lifting tower 1 according to the first embodiment of this invention. In this figure, it is possible to notice the presence of two guiding structures 2 in the lifting tower 1 comprising the central structural pipe 3. The lifting tower 1 is kept aligned by the system of this invention comprising the guiding structures 2 which connect the central pipe 3 and the peripheral pipe 5 to guide them. The connecting elements 6 connect the two adjacent guiding structures 2, limiting the distance between them and limiting or reducing the lifting tower bending 1.

FIG. 3 illustrates the connection between the guiding structure 2 and the ending structure 7 from the lifting tower 1.

Alternatively, the lifting tower may not need the central structural pipe 3, as shown in the embodiments of FIGS. 4 to 7, so that the connecting elements 6 become responsible for transferring the thrust generated by the floating tank and the suction pile, in addition to the rigidity (bending and traction) given to the system.

Figure 4:
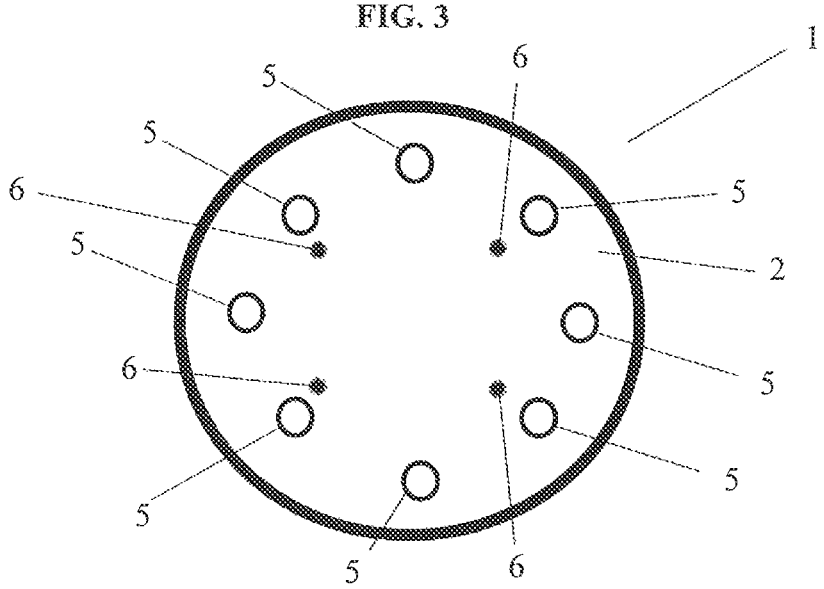
FIG. 4 shows a cross-sectional view of a hybrid lifting tower comprising a guiding system according to an alternative embodiment of this invention.
Figure 5:
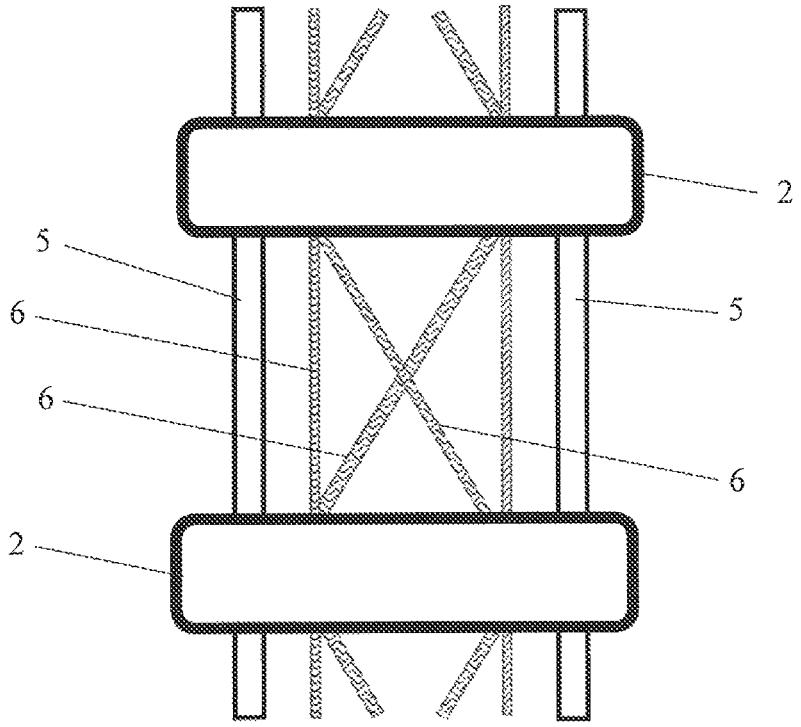
FIG. 5 shows a side view of a portion of the lifting tower according to the first alternative embodiment of this invention.

In a first alternative embodiment, the central pipe 3 is dispensed, and the connecting elements 6 are arranged at a shorter distance from the center of the lifting tower 1 than the peripheral pipes 5, as shown in FIG. 4. Further, according to FIG. 5, the connecting elements 6 are arranged in parallel and bent in relation to the peripheral pipes 5.

Figure 6:
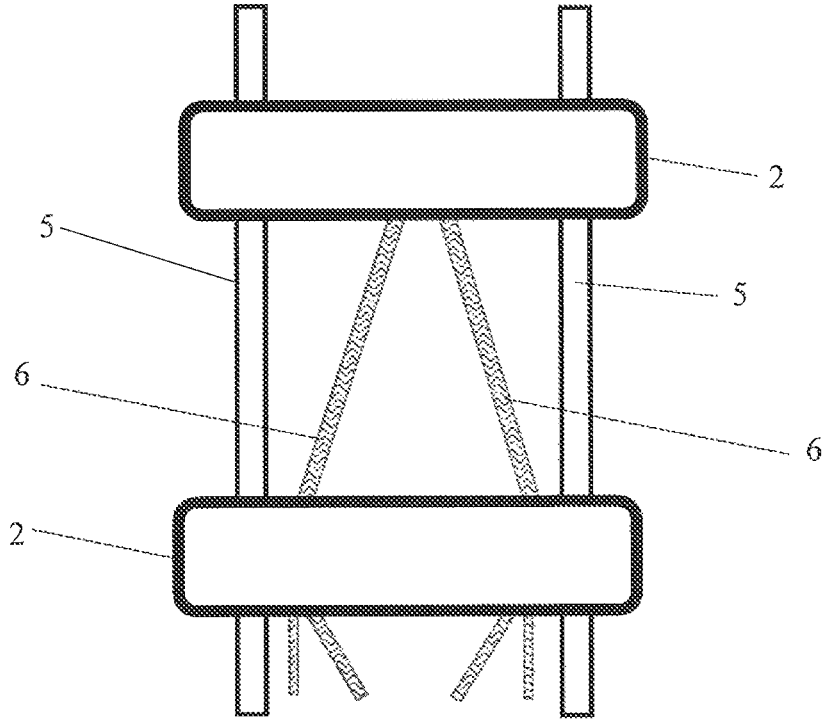
FIG. 6 shows a side view of a portion of the lifting tower according to the second alternative embodiment of this invention.

In a second alternative embodiment, shown in FIG. 6, the connecting elements 6 between guiding structures 2 are alternately arranged bent in relation to the peripheral pipes 5 between two adjacent and parallel guiding structures 2 and bent between two subsequent guiding structures 2.

Figure 7:
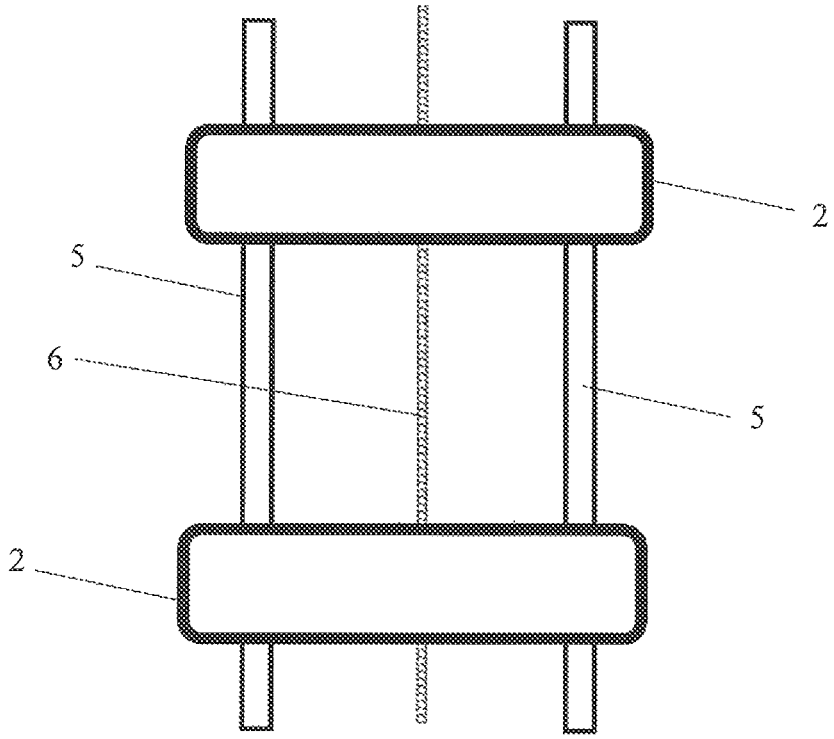
FIG. 7 shows a side view of a portion of the lifting tower according to the third alternative embodiment of this invention.

In a third alternative embodiment, as shown in FIG. 7, the guiding system comprises only one connecting element 6 between adjacent guiding structures 2, wherein the connecting element 6 is connected to the center of the guiding structures 2.

Alternative configurations of the connecting elements 6 differ according to the embodiments and they depend on the structural requirement of the developed lifting tower system 1. As an option, the connecting elements 6 can be cables (tensile resistance only) or a rigid metallic or polymeric element (tensile and compressive resistance) such as a bar, tube or profile I. The connection between the connecting elements 6 and a guiding structure 2 may be by eye, glue, weld or any other connection that supports the efforts involved.

The connecting elements 6 may also function as backup in the event of failure to secure a particular guiding structure 2.

Thus, this invention provides a guiding system in a hybrid lifting tower comprising one or more guiding structures positioned at one or more points along a lifting tower that guides and aligns the peripheral production and injection pipes along the tower. The guiding system of this invention further enables the reduction of fatigue damage in the lifting tower elements and increases the flexural stiffness of the tower. As a result, the guiding system gives greater security to oil and gas production systems.

A wide range of variations on the scope of protection of this application are allowed. Consequently, it is reinforced that this invention is not limited to the particular implementations/patterns described above.

The invention claimed is:

1. A guiding system for a hybrid lifting tower, the guiding system comprising:

a plurality of guiding structures configured to be positioned along the hybrid lifting tower, wherein:

each of the plurality of guiding structures comprises a main part adapted to be attachable to the hybrid lifting tower, the main part being adapted for passage of pipes;

a first of the plurality of guiding structures is connected, by at least one structural connecting element, to at least one of: (i) a second of the plurality of guiding structures which is adjacent to the first of the plurality of guiding structures; or (ii) a tower ending structure;

the at least one structural connecting element is a metal or polymeric cable, or a rigid profile I; and the at least one structural connecting element is bent in relation to the pipes.

2. A hybrid lifting tower comprising at least one guiding system according to claim 1.

3. A guiding system for a hybrid lifting tower, the guiding system comprising:

a plurality of guiding structures configured to be positioned along the hybrid lifting tower, wherein:

each of the plurality of guiding structures comprises a main part adapted to be attachable to the hybrid lifting tower, the main part being adapted for passage of pipes;

a first of the plurality of guiding structures is connected, by at least one structural connecting element, to at least one of: (i) a second of the plurality of guiding structures which is adjacent to the first of the plurality of guiding structures; or (ii) a tower ending structure;

the at least one structural connecting element is a metal or polymeric cable, or a rigid profile I;

the at least one structural connecting element is bent in relation to the pipes between the first of the plurality of guiding structures and the second of the plurality of guiding structures;

the second of the plurality of guiding structures is connected, by at least a first structural connecting element and a second structural connecting element, to a third of the plurality of guiding structures which is adjacent to the second of the plurality of guiding structures; and the first structural connecting element is bent in relation to the pipes; and the second structural connecting element is parallel in relation to the pipes.

4. The guiding system according to claim 3, wherein:

the at least one structural connecting element is connected to the first of the plurality of guiding structures by eye, glue, or weld; and at least one of the first structural connecting element or the second structural connecting element structural is connected to the second of the plurality of guiding structures by eye, glue, or weld.

5. A hybrid lifting tower comprising at least one guiding system according to claim 3.

6. A guiding system for a hybrid lifting tower, the guiding system comprising:

a plurality of guiding structures configured to be positioned along the hybrid lifting tower, wherein:

each of the plurality of guiding structures comprises a main part adapted to be attachable to the hybrid lifting tower, the main part being adapted for passage of pipes;

a first of the plurality of guiding structures is connected, by at least one structural connecting element, to at least one of: (i) a second of the plurality of guiding structures which is adjacent to the first of the plurality of guiding structures; or (ii) a tower ending structure;

the at least one structural connecting element is a metal or polymeric cable, or a rigid profile I;

the at least one structural connecting element includes a plurality of structural connecting elements;

at least a first of the plurality of structural connecting elements is bent in relation to the pipes; and at least a second of the plurality of structural connecting elements is parallel in relation to the pipes.

7. A hybrid lifting tower comprising at least one guiding system according to claim 6.

8. A guiding system for a hybrid lifting tower, the guiding system comprising:

a plurality of guiding structures configured to be positioned along the hybrid lifting tower, wherein:

each of the plurality of guiding structures comprises a main part adapted to be attachable to the hybrid lifting tower, the main part being adapted for passage of pipes;

a first of the plurality of guiding structures is connected, by at least one structural connecting element, to at least one of: (i) a second of the plurality of guiding structures which is adjacent to the first of the plurality of guiding structures; or (ii) a tower ending structure;

the at least one structural connecting element is a metal or polymeric cable, or a rigid profile I;

one of the pipes is a central pipe; and the first of the plurality of guiding structures and the second of the plurality of guiding structures are glued or welded to the central pipe.

9. A hybrid lifting tower comprising at least one guiding system according to claim 8.

* * * * *